US006182380B1

(12) United States Patent
Liley

(10) Patent No.: US 6,182,380 B1
(45) Date of Patent: Feb. 6, 2001

(54) DEMI POINTE EQUALIZER, EXERCISER, AND TENSIONING DEVICE

(76) Inventor: Paul Liley, 835 W. Ninth Ave., Anch, AK (US) 99501

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/098,385

(22) Filed: Jun. 16, 1998

(51) Int. Cl.[7] ..... A43B 19/00; A43B 7/24
(52) U.S. Cl. ..... 36/71; 36/43; 36/144
(58) Field of Search ..... 36/43, 44, 71, 36/88, 142, 143, 144

(56) References Cited

U.S. PATENT DOCUMENTS 1,847,973 * 3/1932 Morton ..... 36/180
2,616,190 * 11/1952 Darby ..... 36/144
3,548,420 * 12/1970 Spence ..... 36/71
4,170,233 * 10/1979 Bunsick ..... 36/44
4,227,320 * 10/1980 Borgeas ..... 36/71
4,372,057 * 2/1983 Nielsen ..... 36/43
4,813,157 * 3/1989 Boisvert et al. ..... 36/91
4,841,648 * 6/1989 Shaffer et al. ..... 36/43
5,327,663 * 7/1994 Pryce ..... 36/144

* cited by examiner

*Primary Examiner*—M. D. Patterson
(74) *Attorney, Agent, or Firm*—Michael J. Tavella

(57) ABSTRACT

A demi pointe equalizer, exerciser, and tensioning device that is a small pad in the general shape of a common big toe. The equalizer pad extends from the tip of the big toe to a point behind the metatarsal parabola. The equalizer pad is designed to support only the big toe. The support system is also designed to be applied in layers, so that correction can be built up slowly, as needed. By using layers of equalizer pads, the ideal thickness of pad can be achieved. This equalizer pad may be attached directly to the bottom of the big toe, or to the sole of a shoe, slipper, sock, sandal, or to an insole to form a system. The pad or system may be constructed from a variety of materials that are matched to a particular activity.

17 Claims, 5 Drawing Sheets

DEMI POINTE EQUALIZER, EXERCISER, AND TENSIONING DEVICE

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to supports for dominance deficiencies of the big toe, and particularly to demi pointe equalizer, exerciser, and tensioning compensation devices for varum and length dominance deficiencies of the big toe.

2. Description of Related Art

Normal walking consists of two distinct phases: the stance phase and the swing phase. The stance phase can be divided into three parts: 1) contact, 2) midstance, and 3) propulsion. When one limb is beginning the stance phase, the other is concluding stance and beginning the swing phase. For years, it was thought that the foot moved down, or planterflexed, to propel us forward. The foot was then thought to be acting as a lever arm, similar to the way a crow bar works. When viewed in terms of the body as a whole, however, it is actually too small to do that effectively.

In reality, it is the hallux complex, foot, leg and thigh that act as the lever from the hip, not the foot alone from the ankle. Using the length provided between the hip and demipointe (hallux complex), we can create a lever effect against the ground, forcing the ground behind us. Since the ground does not move, we instead cause an advance in the forward direction with both the center of gravity located within the head and the center of mass located within the body. The integrated action of these two separate centers, the center of gravity and the center of mass are important to distinguish as being location specific when discussing postural motion. Since the foot is in contact with the ground, its purpose is to create the maximum amount of longitudinal shear, or backwards thrust necessary to push us forward, while coordinating with the body posture to maintain a stabilized and oriented cranium. To accomplish this, the foot undergoes two basic opposing motions. The first motion is supination. Supination prepares the involved musculature for the action of a shock absorbing "lengthening contraction" during the initial pronation interval of contact in the support phase.

Supination is a triplaner motion that occurs on all three cardinal planes of the body. These are called the Frontal, Saggital, and Transverse Planes. The motions that occur are Inversion, Planterflexion, and Adduction and reactively take place at the Subtalar Joint as it acts in concert with an ipsilateral turning out of the hip. The Subtalar Joint is located beneath the ankle joint at the interface of the Talus and the Calcaneous and is made up of three articular facets. These facets allow for freedom in this three-way movement, which allows for active shock absorption during the driving or power segment from midstance to push off. This motion also allows for the foot to be extremely stable under weight bearing conditions as the axis of the rear foot joint (subtalar joint) becomes perpendicular to the axis of the midfoot (midtarsal joint). This perpendicular joint buttress arrangement allows for the stability on the part of the medial longitudinal arch, as held together-congruent with the windlass effected plantar ligament (described by Hicks). The foot undergoes this supinatory motion from the end of the propulsion phase of gait through the swing phase and returns to the fully supinated position so that at contact, it can go through the opposite motion of pronation.

Pronation, like supination, is a triplaner motion reactively taking place at the Subtalar joint in conjunction with a turning in at the hip. Its direction of movement is opposite of supination and is comprised of Eversion, Planterflexion, and Abduction occurring on the same cardinal planes. A muscular lengthening contraction resistance allows the subtalar joint motion of pronation to absorb the shock of the heel strike while dampening the deceleration stress of the body mass acting on the foot and lower limb. This deceleration occurs as the foot follows through to the hallux complex grounding at midstance. Corrected timing of hallux grounding at midstance provides for an increased amount of power and shock absorption to be derived from the medial longitudinal arch. The hallux complex is the grounding buttress for the medial longitudinal arch. The hallux complex acts as vertical posture support stop and as a triggered launching platform. As the hallux dorsiflexes, it creates a lengthening, strengthening and tensioning of structures in preparation for the release of energies during the propulsion phase achieved by the push off of the big toe (hallux). This description of pronation assists in explaining greater energy output and shock absorption. The increase in shock absorption is capable of reducing the stress fracture and shin splint incidence seen with athletes during running and jumping activities. Additionally, the vertical support of the hallux complex immediately lessens the reactive check reining and foreshortening of the posterior postural chain musculature, see, FIG. 1. The posterior chain muscles include the hamstring, calf, peroneus, and foot flexors.

Walking speed propulsion is initiated in the toes by first contacting the ground at the fifth metatarsal and then pronating the foot along the line of the metatarsals and toes as they contact and leave the ground, ending with the big toe complex, which then pushes off at the end of the step. In contrast, if we look at the situation of the hallux complex not being fully grounded in neutral position (midstance), the musculature is found to be in a rigid, braced, shortened condition as an attempt to ground the body posture at midstance. In doing so, some or most of our propulsion phase ability to power, resist and absorb shock from ground force opposition is lost. The hallux complex if properly grounded in time and motion, fully activates the medial longitudinal arch mechanics to create a complete propelling thrust, as well as the protective shock absorption for the dependent body structures.

In many people, however, the foot is not constructed ideally. This flaw is inadequate length and grounding tension of the hallux complex, making it impossible to coordinate its axial support postural requirements during a time motion sequence. In cases where the first metatarsal bone is short, or functionally required to be on an elevated plane above the rest of the foot for working efficiency, the pronation described above does not end with the big toe making contact with the ground in a normal way. Such conditions lead to sagittal motion forefoot roll over linear instability. The result is that the lifting and balancing efforts with the ground are not structurally coordinated with the rest of the foot in holding axial posture. This leads to eventual posture collapse and weakness as the compensating musculature tires at holding correct structural alignment geometry. FIGS.

2 and 3 show a normal foot and a foot with a short first metatarsal bone. These figures also show the roll over leverage points used in the push off of a step. FIG. 2 shows a normal skeletal view of a foot 1. Clearly, when the first metatarsal bone 2 is ahead of or equal to the second metatarsal bone 3 the leverage is straight across the joints as shown. This is shown by the dashed line that shows the proper alignment of the metatarsal joints. FIG. 3 shows a skeletal view of a foot 4 where the leverage points are not properly aligned. Here, the first metatarsal bone 5 is short as compared to a normal foot (e.g., that of FIG. 2). As shown by the two dashed lines in this figure, the end of the first metatarsal bone 5 does not align with the end of the second metatarsal bone 3. This misalignment forces a patient to muscle brace (muscle compensate) and or over pronate (i.e., roll the foot excessively inward) while toeing out in an attempt to allow the big toe to make contact with the ground for the push off. This geometric cascade side loads the knee inward, and produces a counter rotation sheer within the knee joint, and causes other reactive physical problems throughout the kinetic centers of posture.

The kinetic centers of posture collectively have, as a primary survival function purpose, the work of maintaining a stable and oriented cranium. Instability and disorientation are the consequences of losing cranial position during any activity. When viewed in this manner, the cranium is to be considered the upper terminus of the body's postural kinetic chain, which has a corresponding lower terminus at the Demi Pointe support area of the hallux complex. See, FIG. 1.

To address the problems just discussed, several inventions have been developed. These devices address the varum forefoot deformity by attempting to "post" (or to lift and support) the mid and forefoot. These devices tend to support the first and second or even the first, second and third metatarsals. For example, U.S. Pat. No. 5,327,664 to Rothbart teaches a foot orthotic with a forefoot posting shim. The shim is designed to lift the first through third metatarsals on a sloped support. However, for the comfort of the patient, this device is designed to extend only as far as the one-five metatarsal parabola.

U.S. Pat. No. 5,327,663 to Pryce discloses a corrective foot insole for treating a condition known as flexible flat foot. This device has two primary components. First, there is a forefoot portion that provides lift for the two interior toes that runs back almost to the heel. The second component is a support arch that provides additional lift for the metatarsal. The support arch rests on the forefoot portion. Although the Pryce device addresses the problem of the flexible flat foot, it cannot solve the problems of a differentially short and or functionally elevated first metatarsal bone because it provides support for more than just the big toe. Supporting more than just the big toe cannot solve the problem because the support maintains the misalignment between the first and second metatarsal bones (as it does not recognize that the hallux, like the thumb, operates on a different geometric plane than the other digit complexes, which function on a collective plane). As a result, uncoordinated pronation, in an attempt to load the big toe for support and balance of axial posture, becomes even more pronounced and body weight leverages off the second toe complex to an even greater extent.

Finally, these devices are bulky in design, which often causes problems with stock shoes. It is also not practical to combine or substitute them with shoe manufacturer's standard inserts.

BRIEF SUMMARY OF THE INVENTION

The instant invention is a support device to correct for the varum forefoot deformity of a short and or functionally raised and unsupported first metatarsal hallux complex. The device consists of a demi pointe equalizer pad that is attached either to the foot directly, or to a sole, in a more commonly used system. The preferred system is a generally flat resilient, flexible sole, insole or stocking, designed to conform to a user's foot so that the attached demi pointe equalizer pad remains in place under the user's foot. This equalizer pad is a small pad in the general shape of a common big toe. The equalizer pad extends from the tip of the big toe to a point behind the metatarsal parabola. The equalizer pad is designed to support only the big toe complex at a raised elevation, acting as a foot stool, from the rest of the uncompensated foot, giving it increased height. The system is also designed to be applied in layers, so that correction can be built up slowly, or as needed. By using layers of equalizer pads, the ideal thickness of pad can be achieved to fine-tune and coordinate the added balance or lift from the hallux complex to complement a specific activity. Different activities often have dissimilar effective posture support requirements.

Unlike the Rothbart device, discussed above, this device provides full support for the big toe. Unlike Pryce, this device supports only the big toe. This design is superior because it provides for support to the place where it is needed, and only where it is needed. Additionally, this device corrects a time honored problem of human form and function. The benign problem of a postural dyskinesia arising from an uncompensated hallux complex flaw has plagued mankind's attempt to gain and adjust optimum leverage and kinesthetic strength during closed chain biomechanical efforts since time began.

As noted above, the cranium can be considered as the upper terminus of the body's postural kinetic chain, which has a corresponding lower terminus at the demi pointe support area of the hallux complex. For this reason, the instant invention may be considered as a primary cranial positioner with the stated purpose of relieving the foot to ground induced compressive postural muscle bracing patterns required to maintain the cranium in its center of balance position by compensating for the hallux complex inadequacies.

DETAILED DESCRIPTION OF THE INVENTION

Figure 1:
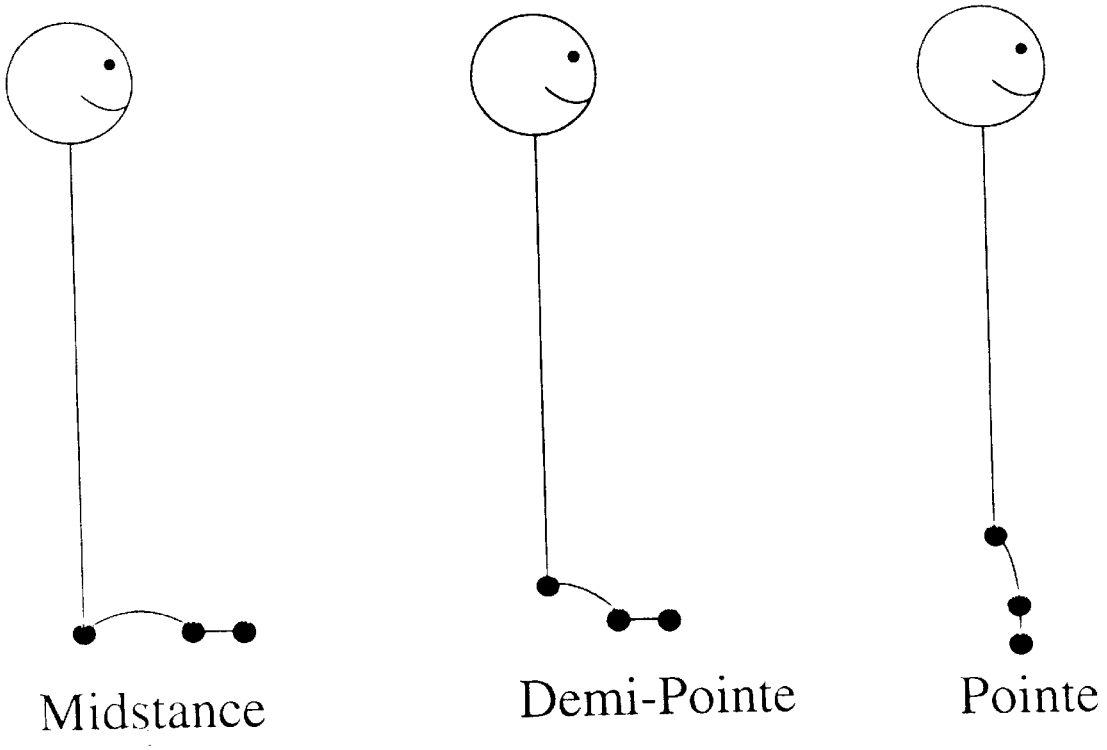
FIG. 1 is a schematic view of the postural chain showing the Midstance, Demi Point and full Point stances.
Figure 2:
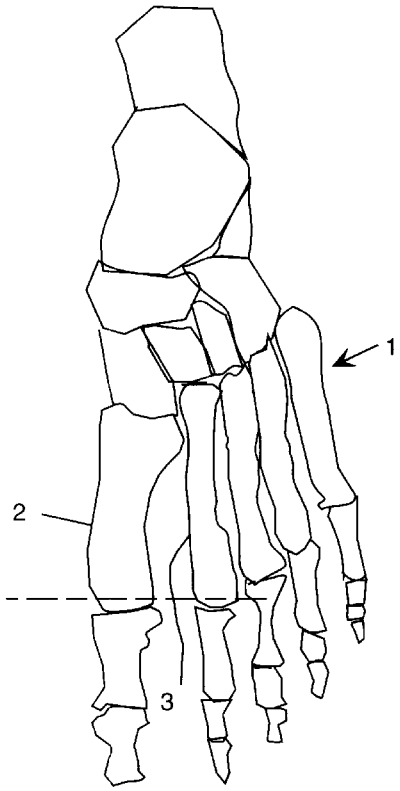
FIG. 2 is a skeletal plan view of a normal foot showing the alignment of the flex points.
Figure 3:
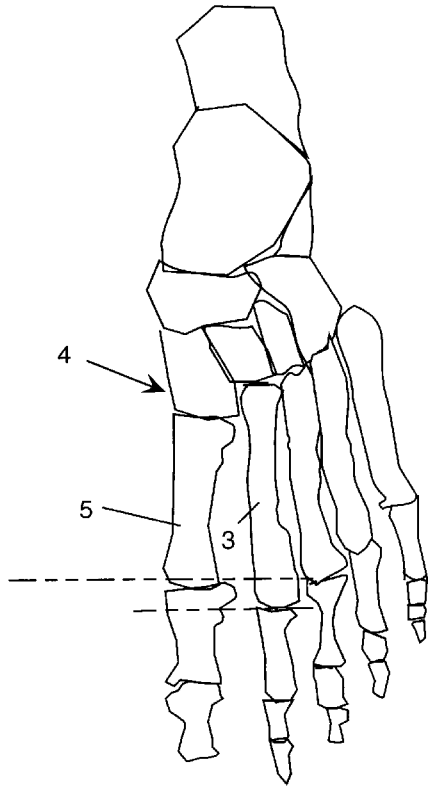
FIG. 3 is a skeletal plan view of a foot having a short big toe bone, showing the shift in placement of the flex points, as a result of this deformity.
Figure 4:
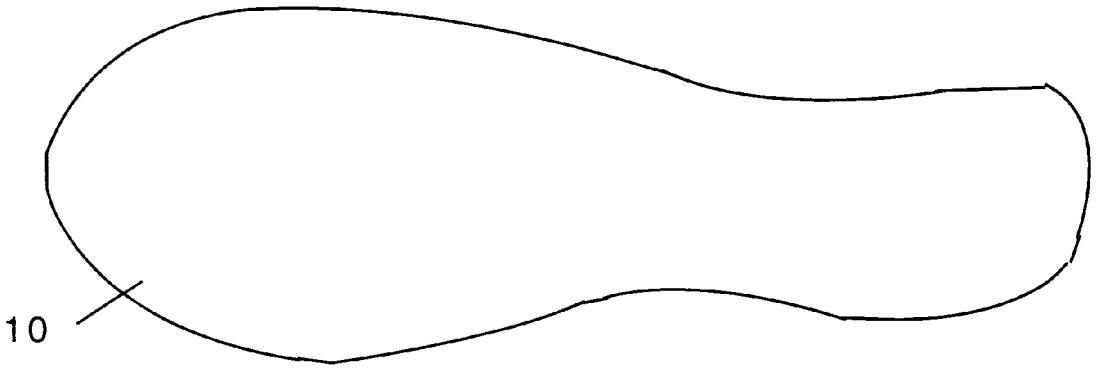
FIG. 4 is a top plan view of the patient insole.

Referring now to FIG. 4, a top view of my new insole 10 is shown. Note that the use of the term "insole" includes soles, insoles and stockings. Unlike previous designs, the insole 10 is flat and resilient. The insole 10 is designed to form fit to a person's foot and shoe, but does not have to permanently change to conform to those shapes. The purpose of the insole 10 is simply to hold the equalizer pad 11 in place. Because the size of the equalizer pad 11 is small, it cannot be easily secured in a shoe or on a foot. The insole 10 is used to maintain the position of the equalizer pad 11 in the shoe. Note also that the pad 11 may be attached directly to the user's foot, if so desired, or attached directly to a sole.

Figure 5:
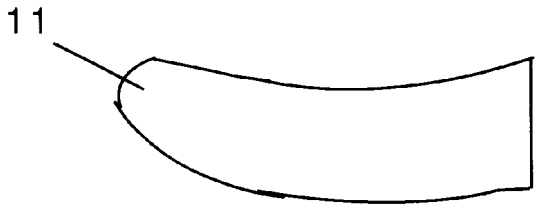
FIG. 5 is a top plan view of a toe support section.
Figure 6:
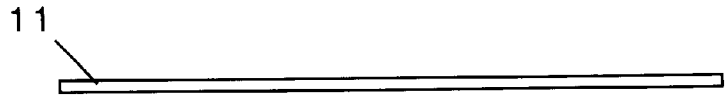
FIG. 6 is a side elevation view of a toe support section.
Figure 7:
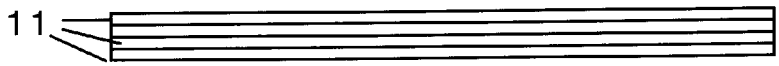
FIG. 7 is a side elevation view a stack of toe support sections, forming a full posting.

FIG. 5 shows a top view of my equalizer pad 11. As shown, the equalizer pad 11 is designed to conform generally to the shape of the a big toe. FIG. 6 is a side view of the equalizer pad 11. Note that this support is a thin strip of resilient material. Support is derived by stacking a number of the equalizer pads 11, as shown in FIG. 7, to elevate the big toe to the proper, functionally tensioned, effective height. Stacking the pads is also important because a person may have to be adjusted gradually to allow for an assessment of the derived advantage for any particular activity. The stack of equalizer pads can be called a posting. In the preferred embodiment, the posting can have a height of 2 millimeters up to as high as can be formed. In the preferred embodiment, however, this height is between 2 and 14 millimeters. Moreover, each person can be easily fitted by choosing the number of equalizer pads 11 needed for a given posting effect. This system results in a simple, quick, inexpensive, fully adjustable modular system to have a custom made postural coordinated support device. With this system, frustration, expense and time are avoided or minimized compared to other conventional attempts to improve foot to ground postural performance.

Figure 8A:
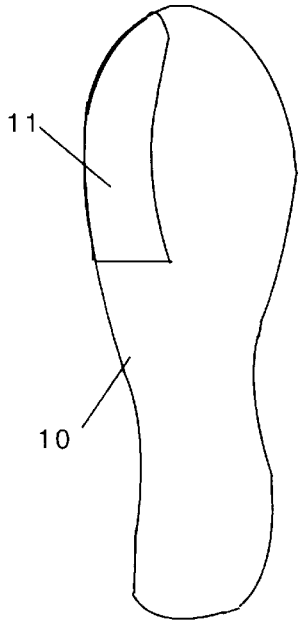
FIG. 8*a* is a bottom plan view of the patient insole with the toe support sections in place.
Figure 8B:
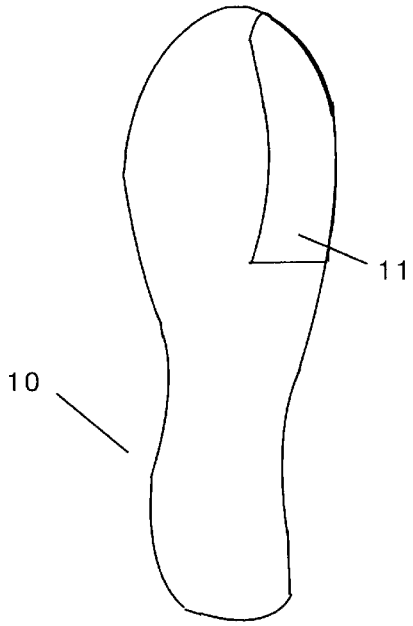
FIG. 8*b* is a top plan view of the patient insole with the toe support sections in place.

FIG. 8*a* shows the bottom of the insole 10 with an equalizer pad 11 in place. This is the preferred embodiment. FIG. 8*b* shows an alternative embodiment where the top of the insole 10 with the equalizer pad 11 shown attached to the top of the insole 10.

Figure 9:
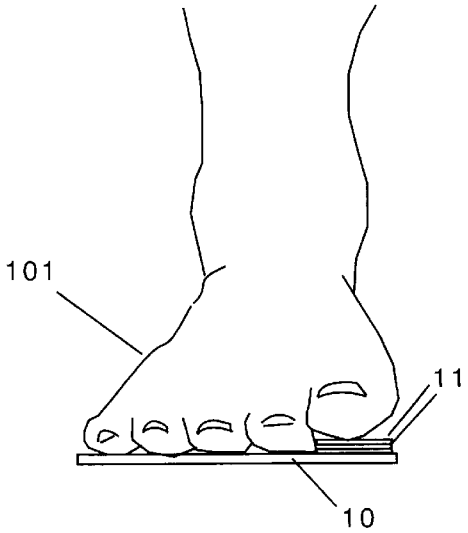
FIG. 9 is a front elevation view of a human foot in place on the device, showing the big toe in a supported position.

FIG. 9 shows a front view of the insole 10 with a stack of equalizer pads 11 in place. A human foot 101 on shown standing on the insole 10. As this figure shows, only the big toe is lifted. The remaining toes are not adjusted. This allows a patient to rotate the foot into the push off position without having to over pronate the foot.

The equalizer pad 11 is designed to extend back to a point behind the ball of the foot. In this way, the patient is not bothered by the support when it is in place. There is no rubbing, pinching, or other action caused by the support, and no hindrance to dorsiflexion of the hallux complex caused by a thickened sole at the toe flex point.

The physical equalizer pad system can be made from various natural or synthetic materials, gas or fluid filled chambers or other materials, depending on the particular postural activity enhancement requirement. The desired material may also be made using magnetic, paramagnetic or diamagnetic materials to affect the anionic-cationic ends of the body.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A demi pointe equalizer for use in an article of footwear, having an upper portion and a sole portion comprising:

a) an insole formed on a top surface of said sole portion and being integral to said sole portion, said insole also having an equalizer pad portion formed in said insole, said equalizer pad portion having a curvilinear shape having an outside edge and an inside edge, and wherein said outside edge is curved to conform to an an outside edge of said sole portion, said equalizer pad portion having a width that extends from the outside edge of said sole portion to a point between the big toe and the second toe of a human foot, said equalizer pad portion having a length extending from a front edge of said sole portion to a traverse line immediately behind the sesamoid bones, said equalizer pad also protruding above the top surface of said sole portion.

2. The demi pointe equalizer of claim 1 further comprising an equalizer pad, having the same configuration as said equalizer pad portion, being fixedly attached to said equalizer pad portion of said sole portion.

3. The demi pointe equalizer of claim 2 further comprising a plurality of equalizer pads, having the same configuration as said equalizer pad portion, being fixedly attached to said equalizer pad, thereby forming a posting having a height.

4. The demi pointe equalizer of claim 3 wherein the height of the posting does not exceed a maximum height of about 10 millimeters.

5. A demi pointe equalizer system comprising:

a) a support member, having a thin and flexible surface, generally conforming to a shape of an interior of a shoe; and b) an equalizer pad, having a curvilinear shape having an outside edge and an inside edge, and wherein said outside edge is curved to conform to an inside surface of a said shoe, said equalizer pad having a width that extends from the inside surface of said shoe to a point between the big toe and the second toe of a human foot, said equalizer pad having a length extending from an inside front edge of said shoe to a traverse line immediately behind the sesamoid bones, said equalizer pad also having a thickness greater than a thickness of said support member.

6. The demi pointe equalizer system of claim 5 wherein the support member has a top and wherein the equalizer pad is attached to top of said support member.

7. The demi pointe equalizer system of claim 5 wherein the support member has a bottom and the equalizer pad is attached to the bottom of the support member.

8. The demi pointe equalizer system of claim 5 further comprising a second equalizer pad being fixedly attached to said equalizer pad.

9. The demi pointe equalizer system of claim 8 further comprising a plurality of equalizer pads, being fixedly attached to said second equalizer pad, thereby forming a posting having a height.

10. The demi pointe equalizer system of claim 9 wherein the height of the posting does not exceed a maximum height of about 10 millimeters.

11. The demi pointe equalizer system of claim 5 wherein the support member is a sole of a shoe.

12. The demi pointe equalizer system of claim 5 wherein the support member is an insole, removably installed in a shoe.

13. The demi pointe equalizer system of claim 5 wherein the support member is a stocking.

14. A demi pointe equalizer system comprising:

a) an insole, having a thin and flexible surface, generally conforming to a shape of an interior of a shoe; and b) a plurality of equalizer pads, each of said plurality of equalizer pads having a curvilinear shape having an outside edge and an inside edge, and wherein said outside edge is curved to conform to an inside surface of said shoe, said equalizer pad having a width that extends from the inside surface of said shoe to a point between the big toe and the second toe of a human foot, each of said plurality said equalizer pad having a length extending from an inside front edge of said shoe to a traverse line immediately behind the sesamoid bones, said equalizer pad also having a thickness greater than a thickness of said insole.

15. The demi pointe equalizer system of claim 14 wherein the insole is made of a thin flexible member.

16. The demi pointe equalizer system of claim 14 wherein the plurality of equalizer pads comprises a plurality of thin flexible members, fixedly attached together.

17. The demi pointe equalizer system of claim 14 wherein the height of the posting is about between 2 and 14 millimeters.

* * * * *